US012454875B2

(12) United States Patent
Clayton et al.

(10) Patent No.: US 12,454,875 B2
(45) Date of Patent: Oct. 28, 2025

(54) SYSTEM AND METHODOLOGY FOR SELECTIVE ACTUATION OF A DOWNHOLE DEVICE

(71) Applicant: SCHLUMBERGER TECHNOLOGY CORPORATION, Sugar Land, TX (US)

(72) Inventors: David Clayton, Angleton, TX (US); Jerome Prost, Clamart (FR); Brad Swenson, Friendswood, TX (US); Michael Jasper, Saint Johns, FL (US); Gabriel Isaicu, Missouri City, TX (US); Dongyang Chen, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1237 days.

(21) Appl. No.: 16/781,826

(22) Filed: Feb. 4, 2020

(65) Prior Publication Data

US 2020/0248533 A1 Aug. 6, 2020

Related U.S. Application Data

(60) Provisional application No. 62/801,611, filed on Feb. 5, 2019.

(51) Int. Cl.

| | |
|---|---|
| ***E21B 23/04*** | (2006.01) |
| ***E21B 34/14*** | (2006.01) |
| ***E21B 43/12*** | (2006.01) |

(52) U.S. Cl.

CPC ..... *E21B 34/14* (2013.01); *E21B 43/12* (2013.01)

(58) Field of Classification Search

CPC .. E21B 23/0412; E21B 23/04; E21B 23/0421; E21B 34/102; E21B 34/10;

(Continued)

(56) References Cited

U.S. PATENT DOCUMENTS 3,970,034 A * 7/1976 Kirk ..... F15B 15/2838 137/555
4,185,541 A * 1/1980 Milberger ..... E21B 33/0355 91/526

(Continued)

FOREIGN PATENT DOCUMENTS

WO 2013074392 A1 5/2013

OTHER PUBLICATIONS

International Preliminary Report on Patentabitliy issued in PCT Application PCT/US2017/036458 dated Dec. 10, 2019 (12 pages).

(Continued)

*Primary Examiner* — Edwin J Toledo-Duran
(74) *Attorney, Agent, or Firm* — Jeffrey D. Frantz

(57) ABSTRACT

A technique facilitates actuation of flow control valves or other types of downhole devices. According to an embodiment, the downhole devices are coupled with corresponding first hydraulic control lines for hydraulically actuating each downhole device to a first operational position. The downhole devices also are coupled to a common second hydraulic control line which may be used in cooperation with selective hydraulic circuits to actuate individual downhole devices to a second operational position. For example, an individual selective hydraulic circuit may be coupled between each first hydraulic control line and the common second hydraulic control line at each downhole device. The selective hydraulic circuit is configured to enable actuation of the corresponding downhole device to the second operational position.

23 Claims, 4 Drawing Sheets

(58) Field of Classification Search
CPC ..... E21B 34/14; E21B 43/12; E21B 43/14; F16K 31/1221; F16K 31/1225
See application file for complete search history.

(56) References Cited

U.S. PATENT DOCUMENTS 4,271,867 A * 6/1981 Milberger ..... E21B 33/0355 137/625.21
4,549,578 A * 10/1985 Hibbs ..... E21B 33/0355 137/552.5
4,636,010 A * 1/1987 Adachi ..... B60T 8/4225 303/115.4
4,636,934 A * 1/1987 Schwendemann ..... E21B 34/16 702/6
4,896,722 A 1/1990 Upchurch
4,942,926 A * 7/1990 Lessi ..... E21B 23/14 166/66.4
5,832,996 A * 11/1998 Carmody ..... E21B 34/066 137/625.68
6,279,651 B1 * 8/2001 Schwendemann ..... E21B 41/0035 166/54.1
6,405,803 B1 6/2002 Giroux et al.
6,422,317 B1 7/2002 Williamson, Jr.
6,494,265 B2 12/2002 Wilson et al.
6,536,530 B2 3/2003 Schultz et al.
6,567,013 B1 * 5/2003 Purkis ..... E21B 43/11852 340/854.3
6,585,051 B2 7/2003 Purkis et al.
6,763,892 B2 7/2004 Kaszuba
6,782,952 B2 8/2004 Garay et al.
6,786,285 B2 * 9/2004 Johnson ..... E21B 43/32 166/250.15
6,869,063 B2 3/2005 Gunnarsson et al.
6,951,331 B2 10/2005 Haughom et al.
7,013,980 B2 3/2006 Purkis et al.
7,055,598 B2 6/2006 Ross et al.
7,195,033 B2 * 3/2007 Mayeu ..... G01B 11/002 166/334.1
7,377,327 B2 5/2008 Jackson
7,387,165 B2 * 6/2008 Lopez de Cardenas ..... E21B 43/14 166/313
7,510,013 B2 3/2009 Kimpel
7,926,569 B1 4/2011 Wintill et al.
8,006,768 B2 8/2011 Powell et al.
8,056,643 B2 11/2011 Basmajian et al.
8,157,016 B2 4/2012 James
8,186,439 B2 5/2012 Lauderdale
8,322,446 B2 * 12/2012 Smithson ..... E21B 34/10 166/381
8,397,741 B2 3/2013 Bisset
9,228,402 B2 1/2016 Strilchuk
9,228,423 B2 * 1/2016 Powell ..... E21B 34/066
9,376,889 B2 6/2016 Reid et al.
10,724,334 B2 7/2020 Poluchalla et al.
10,745,998 B2 * 8/2020 Prost ..... E21B 23/042
10,961,819 B2 * 3/2021 Honeker ..... E21B 47/06
11,591,886 B2 * 2/2023 Lisk ..... E21B 34/08
11,702,905 B2 * 7/2023 Lisk ..... E21B 34/066 166/250.01
11,761,300 B2 * 9/2023 Prost ..... E21B 43/12 166/373
12,163,391 B2 * 12/2024 Provost ..... E21B 23/0421
2002/0014338 A1 2/2002 Purkis et al.
2003/0010600 A1 * 1/2003 Speers ..... B65G 41/008 198/300
2006/0196660 A1 * 9/2006 Patel ..... E21B 43/12 166/250.15
2007/0163774 A1 * 7/2007 Hosatte ..... E21B 43/14 166/66.6
2008/0000643 A1 1/2008 Kimpel
2009/0014168 A1 * 1/2009 Tips ..... E21B 34/102 166/73
2009/0050333 A1 * 2/2009 Smith ..... E21B 34/10 166/105
2009/0223663 A1 * 9/2009 Snider ..... E21B 47/00 166/250.15
2009/0223670 A1 * 9/2009 Snider ..... E21B 43/26 166/308.1
2009/0243875 A1 * 10/2009 Mandrou ..... E21B 34/10 340/854.9
2009/0283276 A1 * 11/2009 Mandrou ..... E21B 34/10 166/375
2010/0038093 A1 * 2/2010 Patel ..... E21B 43/12 166/373
2010/0212521 A1 8/2010 Resch et al.
2011/0067886 A1 3/2011 Moen
2011/0100645 A1 5/2011 Yapici
2012/0067593 A1 * 3/2012 Powell ..... E21B 34/066 166/373
2012/0125628 A1 * 5/2012 Reid ..... E21B 34/10 166/324
2012/0168174 A1 * 7/2012 Vaghi ..... E21B 34/10 166/73
2012/0291889 A1 * 11/2012 Choi ..... F02D 13/0253 137/512
2014/0014373 A1 1/2014 Richards
2014/0034160 A1 * 2/2014 Kato ..... G05G 5/06 137/561 R
2015/0107848 A1 4/2015 Leitch
2016/0312579 A1 10/2016 Green et al.
2016/0319635 A1 11/2016 Du et al.
2017/0022790 A1 * 1/2017 Leitch ..... F15B 11/20
2020/0277839 A1 9/2020 Clayton
2021/0246761 A1 * 8/2021 Reid ..... F16K 17/34

OTHER PUBLICATIONS

International Search Report and Written Opinion issued in PCT Application PCT/US2017/036458 dated Feb. 28, 2018 (16 pages).

* cited by examiner

SYSTEM AND METHODOLOGY FOR SELECTIVE ACTUATION OF A DOWNHOLE DEVICE

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application claims priority benefit of U.S. Provisional Application No. 62/801,611, filed Feb. 5, 2019, the entirety of which is incorporated by reference herein and should be considered part of this specification.

BACKGROUND

In many well applications, a well string is deployed downhole with flow control valves which may be actuated to control fluid flow with respect to various well zones. For example, flow control valves may be actuated between an open flow position, allowing fluid to flow into the well string from a surrounding well zone, and a closed position blocking the inflow of fluid. The shifting of flow control valves between operational positions may be controlled by supplying hydraulic actuation fluid to each flow control valve via a dedicated open hydraulic line and a dedicated close hydraulic line. However, well strings often employ a relatively large number of flow control valves and this leads to a corresponding large number of open hydraulic lines and close hydraulic lines. Some well systems may employ a single close hydraulic line and/or a single open hydraulic line but this results in closing and/or opening of the flow control valves collectively rather than individually.

SUMMARY

In general, a system and methodology are provided for facilitating actuation of flow control valves or other types of downhole devices. According to an embodiment, the downhole devices are coupled with corresponding first hydraulic control lines for hydraulically actuating each downhole device to a first operational position. The downhole devices also are coupled to a common second hydraulic control line which may be used in cooperation with selective hydraulic circuits to actuate individual downhole devices to a second operational position. For example, an individual selective hydraulic circuit may be coupled between each first hydraulic control line and the common second hydraulic control line at each downhole device. The selective hydraulic circuit is configured to enable actuation of the corresponding downhole device to the second operational position.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
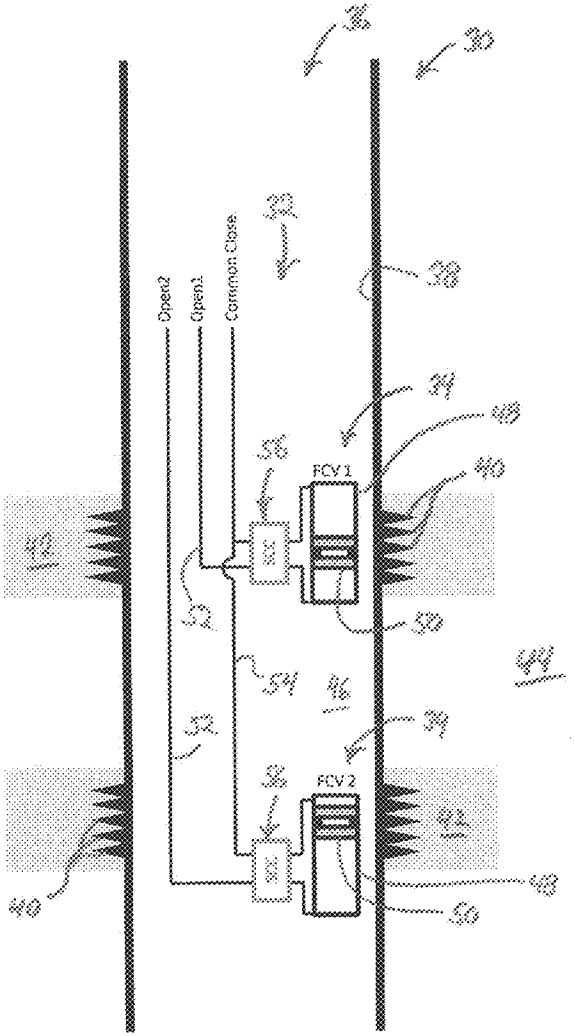
FIG. 1 is a schematic illustration of a well system having a well string deployed in a borehole and including a plurality of actuatable downhole devices, e.g. flow control valves, controlled via a selective hydraulic circuit, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate actuation of flow control valves or other types of downhole devices. According to an embodiment, the downhole devices may be deployed along a well string positioned in a borehole. The downhole devices are coupled with corresponding first hydraulic control lines for hydraulically actuating each downhole device to a first operational position. Additionally, the downhole devices also are coupled to a common second hydraulic control line which may be used in cooperation with selective hydraulic circuits to actuate individual downhole devices to a second operational position.

For example, an individual selective hydraulic circuit may be coupled between each first hydraulic control line and the common second hydraulic control line at each downhole device. Depending on the embodiment, each selective hydraulic circuit may be coupled with a corresponding downhole device; formed as part of the downhole device; or otherwise suitably coupled with the downhole device to provide the desired device actuation. The selective hydraulic circuits are configured to enable individual actuation of corresponding downhole devices to the second operational position via the single common second hydraulic control line, i.e. without adding additional second hydraulic control lines.

If the downhole devices are in the form of flow control valves, the selective hydraulic circuit enables the selective closing of a particular flow control valve where multiple flow control valves share a common close hydraulic line but have separate open hydraulic lines. In this type of embodiment, the selective hydraulic circuit is in the form of a selective close circuit. However, the reverse also may be implemented. In the reverse implementation, the selective hydraulic circuit enables a selective opening of a particular flow control valve where multiple flow control valves share a common open hydraulic line but have separate close hydraulic lines.

According to an example using flow control valves, the selective hydraulic circuit is in the form of a selective close circuit. In this example, a selective close circuit is connected to each flow control valve and the flow control valves may be quick close flow control valves. Use of the selective close circuits and corresponding flow control valves enables individual flow control valves to be selected for closure without closing the entire group of flow control valves even though the flow control valves are connected to a common close hydraulic line. To close a specific flow control valve, pressure is first applied to the open hydraulic line associated with the specific flow control valve to be closed. The corresponding selective close circuit is actuated by this pressure in the open hydraulic line to a position enabling closure of that specific flow control valve via application of pressure through the common close hydraulic line.

Referring generally to FIG. 1, an example of a well system 30 is illustrated. The well system 30 may comprise a well string 32, e.g. a well completion system, having a plurality of hydraulically controlled devices 34 deployed in a borehole 36, e.g. a wellbore. In the example illustrated, the well completion system 32 is deployed downhole within well casing 38 or within other types of tubing.

The well casing 38 may be perforated with a plurality of perforations 40 extending into a plurality of corresponding well zones 42 located in a surrounding formation 44. The perforations 40 enable communication of fluids between the well zones 42 of formation 44 and an interior 46 of the well casing 38. In the example illustrated, the plurality of hydraulically controlled devices 34 comprises a plurality of flow control valves 48, which may be individually actuated to control the flow of fluid, e.g. well fluid, between each well zone 42 and a region within well casing 38. For example, each flow control valve 48 may be actuated to control the inflow of well fluids from a corresponding well zone 42 to the interior of well completion 32, e.g. to the interior of production tubing.

For purposes of explanation, well system 30 will be described as having flow control valves 48 although other embodiments may use other types of hydraulically actuated devices 34 controlled via actuator pistons 50. In the example illustrated, each flow control valve 48 comprises an actuator piston 50 movable in a first direction via hydraulic actuating fluid supplied through a first control line 52 and in a second direction via hydraulic actuating fluid supplied through a second control line 54. With respect to each flow control valve 48 (or each hydraulically controlled device 34), a selective hydraulic circuit 56, e.g. a selective close circuit, is coupled between the first control line 52 and the second control line 54.

When the well system 30 includes flow control valves 48, the first control line 52 may be an open control line through which hydraulic actuating fluid is directed to move the actuator piston 50 and corresponding flow control valve 48 to an open flow position. The second control line 54 may be a close control line through which hydraulic actuating fluid is directed to move the actuator piston 50 and corresponding flow control valve 48 to a closed flow position. In this embodiment, each flow control valve 48 is connected to a separate, dedicated open control line 52 while a common close control line 54 is connected to the plurality of flow control valves 48.

Figure 2:
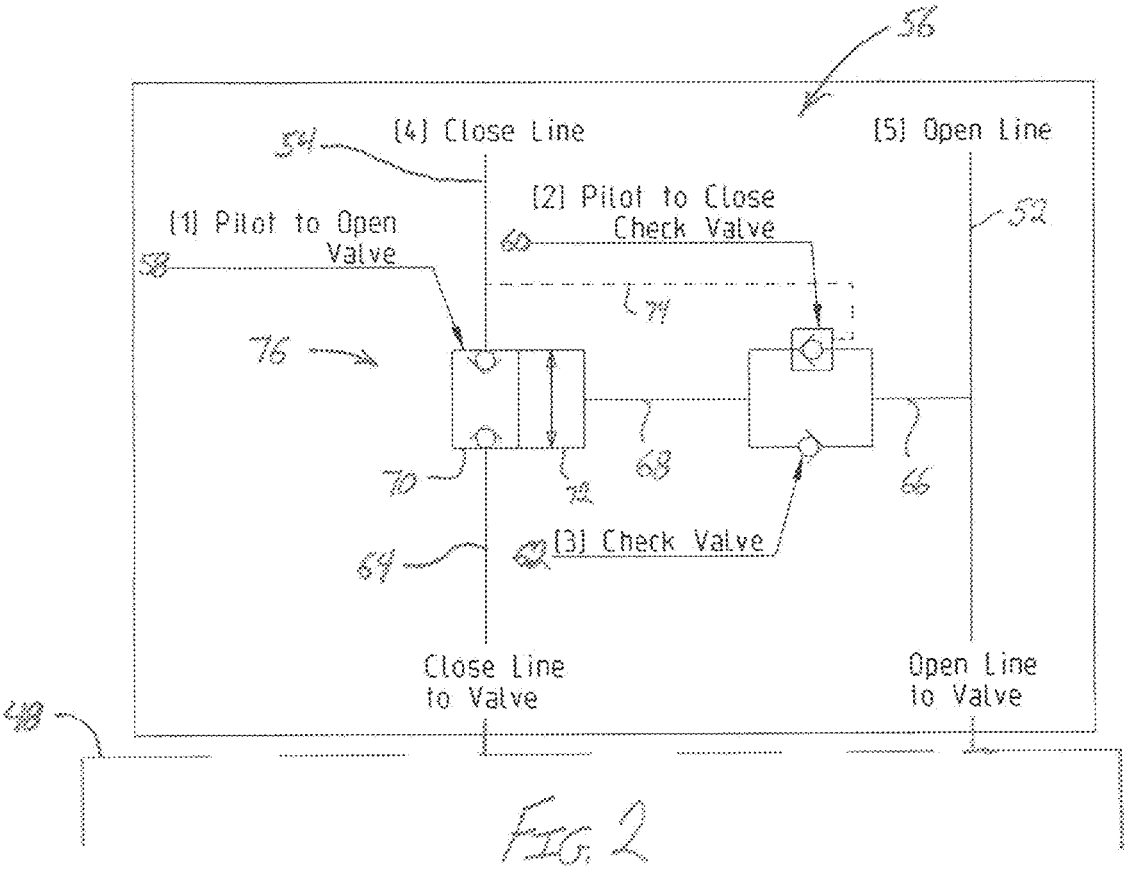
FIG. 2 is a schematic illustration of an example of the selective hydraulic circuit, e.g. a selective close circuit, configured to enable actuation of individual downhole devices, e.g. individual flow control valves, to different operational positions, according to an embodiment of the disclosure.

Referring generally to FIG. 2, an example of selective hydraulic circuit 56 is illustrated as a selective close circuit. However, the selective hydraulic circuit 56 could be connected as a selective open circuit or as a selective actuation circuit for actuating other types of individual hydraulically controlled devices 34 connected along a common hydraulic control line. In the example illustrated, the selective close circuit 56 is connected between the common close line 54 and the open line 52 of a corresponding flow control valve 48. The selective close circuit 56 enables closing of the individual flow control valve 48 independently of the other flow control valves 48.

In the embodiment illustrated in FIG. 2, the selective close circuit 56 comprises a pilot to open valve 58 for isolating the flow control valve 48 from the common close line 54. Additionally, the selective close circuit 56 comprises a pilot to close check valve 60 which is able to hold open the pilot to open valve 58. The selective close circuit 56 also comprises a check valve 62 which allows pressure from the open line 52 to open the pilot to open valve 58.

The selective close circuit 56 is positioned to isolate the common close line 54 extending to the surface from a close line segment 64. In the example illustrated, pilot to open valve 58 is positioned between common close line 54 and close line segment 64, which is routed to flow control valve 48. The open line 52 is connected with both the pilot to close check valve 60 and the check valve 62 via a control line segment 66. Additionally, a control line segment 68 extends between the pilot to open valve 58 and both the pilot to close check valve 60 and the check valve 62 on a side opposite from control line segment 66.

If pressure is applied solely through the close line 54, the pressure has no effect on the flow control valve 48 because it is blocked by a first side 70 (a closed flow side) of the pilot to open valve 58. However, if pressure is first applied through the open line 52 and held followed by applying pressure to the close line 54 and releasing pressure from the open line 52, the corresponding flow control valve 48 closes.

In operation, when the open line 52 is pressurized, the pressurized actuating fluid flows past the check valve 62 and acts against the pilot to open valve 58. The pressure shifts the pilot to open valve 58 such that a second side 72 (an open flow side) is aligned with close line 54 and close line segment 64, thus allowing communication from the close line 54 to the flow control valve 48.

Maintaining pressure on the open line 52 and pressurizing the close line 54 causes the pilot to close check valve 60 to hold the pilot to open valve 58 in this open flow position. In this position, the pressure in close line 54 acts against the pilot to close check valve 60 via a pilot line 74 so as to hold the pilot to close check valve 60 in the closed position. As a result, hydraulic actuating fluid is trapped in control line segment 68 and the pilot to open valve 58 is held in the open flow position. Accordingly, after pressure is released from the open line 52 the pilot to open valve 58 remains in the open flow position and the flow control valve 48 may be closed as hydraulic actuating fluid is directed through close line 54, open flow side 72, and close line segment 64 to actuator piston 50 of the valve 48.

Subsequently, pressure may be released from the close line 54 so that the pilot to close check valve 60 may release the pressure holding the pilot to open valve 58 in the open flow position. The pilot to open valve 58 is then shifted to the closed flow position 70. By way of example, the pilot to open valve 58 may be spring biased to the closed flow position 70.

At this stage, the close line 54 is again isolated from the corresponding flow control valve 48. The flow control valve 48 may be opened simply by releasing pressure in close line 54 and applying pressure in open line 52. The pressure in open line 52 moves through check valve 62 and shifts pilot to open valve 58 to the open flow position. In this position, pressurized hydraulic actuating fluid is delivered through open line 52 to the corresponding actuator piston 50 of the flow control valve 48. The inflowing hydraulic actuating fluid shifts the actuator piston 50 and thus the flow control valve 48 in the open direction while fluid from the other side of actuator piston 50 flows out through close line 54. Accordingly, the pilot to open valve 58, pilot to close check valve 60, and check valve 62 cooperate as an arrangement of valves 76 configured to permit flow of actuating fluid from the common close line 54 to a flow control valve actuator piston 50 of a corresponding flow control valve 48 to close the corresponding flow control valve 48 upon application of a pressure increase in the corresponding open line 52 followed by a pressure decrease in the open line 52.

Figure 3:
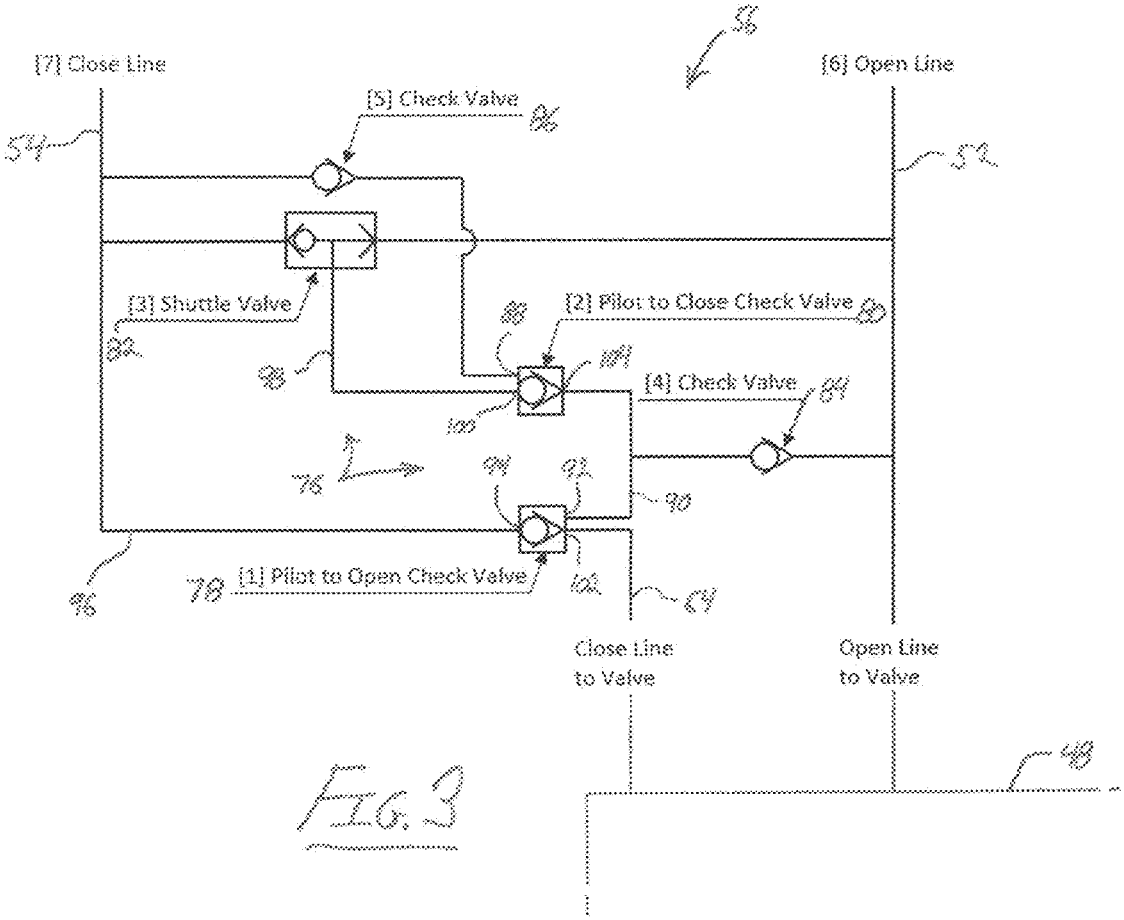
FIG. 3 is a schematic illustration of another example of the selective hydraulic circuit, e.g. a selective close circuit, configured to enable actuation of individual downhole devices, e.g. individual flow control valves, to different operational positions, according to an embodiment of the disclosure.

Referring generally to FIG. 3, another embodiment of the selective hydraulic circuit 56 is illustrated as a selective close circuit. In this example, the selective close circuit 56 is connected between the common close line 54 and the open line 52 of a corresponding flow control valve 48. The selective close circuit 56 enables closing of the individual flow control valve 48 independently of the other flow control valves 48.

In the embodiment illustrated in FIG. 3, the selective close circuit 56 comprises another arrangement of valves 76. As discussed above, the arrangement of valves 76 is configured to permit flow of actuating fluid from the common close line 54 to a flow control valve actuator piston 50 of a corresponding flow control valve 48 to close the corresponding flow control valve 48 upon application of a pressure increase followed by a pressure decrease in the corresponding open line 52.

According to an embodiment, the selective close circuit 56 comprises a pilot to open check valve 78 for isolating the flow control valve 48 from the common close line 54. Additionally, the selective close circuit 56 comprises a pilot to close check valve 80 which is able to hold open the pilot to open valve 78. A shuttle valve 82 is positioned to hold the pilot to close check valve 80 in a closed position. Additionally, a check valve 84 allows pressure applied through the open line 52 to open the pilot to open valve 78. A check valve 86 is connected between the common close line 54 and pilot to close check valve 80 to maintain hydrostatic pressure at a middle port 88 of the pilot to close check valve 80.

As with the previous embodiment described above, the selective close circuit 56 isolates the close line 54 from close line segment 64. If pressure is applied solely through the close line 54, the pressure has no effect on the flow control valve 48. However, if pressure is first applied through the open line 52 and held followed by applying pressure to the close line 54 and releasing pressure from the open line 52, the corresponding flow control valve 48 closes.

In operation, when the open line 52 is pressurized the pressurized hydraulic actuating fluid flows past the check valve 84, through a control line segment 90, and to a port 92 of pilot to open check valve 78 so as to open the pilot to open check valve 78. In this configuration, the pressurized hydraulic actuating fluid flowing through open line 52 is allowed to open the flow control valve 48. In the meantime, the pressurized actuating fluid flows out of port 94, through control line segment 96, through shuttle valve 82, through control line segment 98, and into a port 100 of piloted close check valve 80. The pressure at port 100 acts to close the pilot to close check valve 80.

Maintaining pressure on the open line 52 and pressurizing the close line 54 continues to maintain the pilot to close check valve 80 in a closed position and the pilot to open check valve 78 in an open position. After pressure is released from the open line 52, pressure from the close line 54 is able to flow past the shuttle valve 82 while keeping the pilot to close check valve 80 closed and holding the pilot to open check valve 78 open. This allows the pressurized hydraulic actuating fluid to flow through close line 54, through pilot to open check valve 78, out through a port 102, and through control line segment 64 so as to close the flow control valve 48.

Pressure may then be released from the close line 54 which causes the pilot to close check valve 80 to release the pressure in control line segment 90 holding pilot to open check valve 78 in the open position. The pressure is released through a port 104 and port 88 of pilot to close check valve 80 and then through check valve 86. Upon release of the pressure, the pilot to open check valve 78 shifts to a closed position and the close line 54 is again isolated from the flow control valve 48. At this stage, the flow control valve 48 may again be selectively opened by applying pressure in open line 52, as described above.

Figure 4:
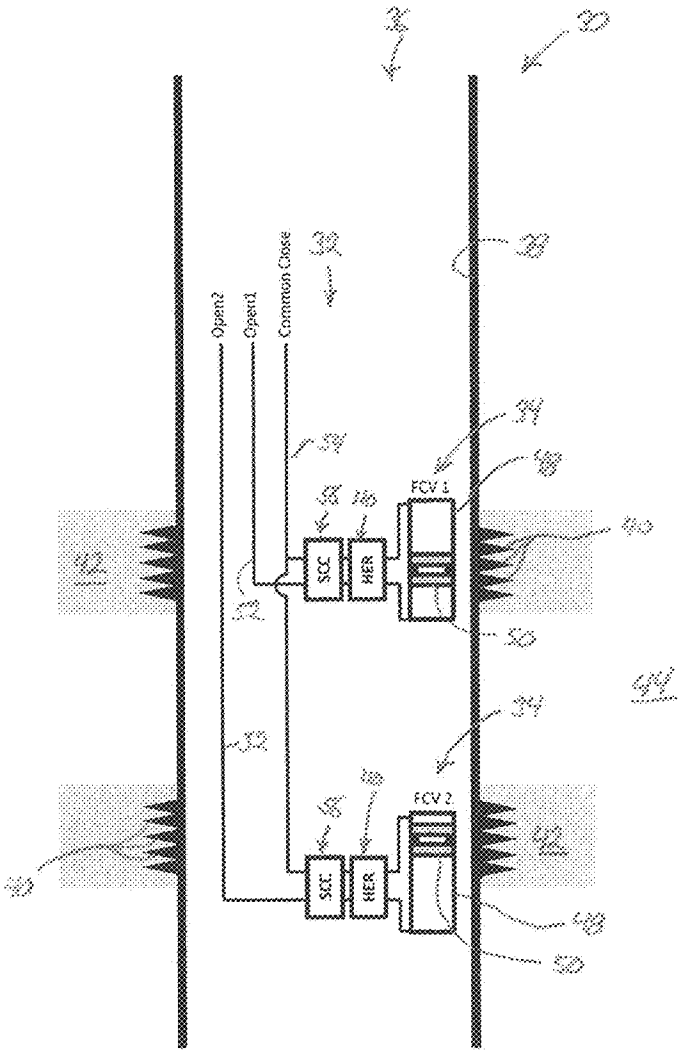
FIG. 4 is a schematic illustration of another example of a well system having a well string deployed in a borehole and including a plurality of actuatable downhole devices, e.g. flow control valves, controlled via a common hydraulic control line, according to an embodiment of the disclosure.

Referring generally to FIG. 4, another embodiment of well system 30 is illustrated. In this example, a hydraulic enabled regulator (HER) circuit 110 is disposed between each selective hydraulic circuit 56 and the corresponding hydraulically actuated device 34, e.g. flow control valve 48. The hydraulic enabled regulator circuit 110 provides the functionality of actuating the device 34 step-by-step in one direction while allowing the hydraulically actuated device 34 to move along a full stroke, from any position, when actuated in the other direction. The hydraulic enabled regulator circuit 110 also avoids the creation of a hydraulic lock of the actuator piston while no hydraulic control is applied. This ensures that the downhole device 34/actuator piston 50 can be mechanically shifted in case of failure of the primary hydraulic operation system or hydraulic control lines.

According to an embodiment, the hydraulic enabled regulator circuit 110 allows specific volumes, e.g. two specific volumes, of input flow of hydraulic fluid to enter the downhole device 34, e.g. flow control valve 48, during actuation in the incremental direction. For example, when the well system 30 comprises flow control valves 48, the incremental direction for each flow control valve 48 may be in the open direction. With respect to the specific volumes, the first volume may be restricted to entry on the first actuation, and the second volume enters on each subsequent actuation. If the downhole device 34 is a flow control valve 48, for instance, the first volume of actuating fluid may enter during the first actuation from the fully closed position, and the second volume of actuating fluid enters for each subsequent incremental actuation toward fully open.

The downhole device 34 may be shifted in the other direction from any position in a single, continuous stroke. After opening the flow control valve 48, for example, the flow control valve 48 may be shifted to a closed position from any position with one actuation. This closing actuation may be used to effectively shift the flow control valve 48 to a closed position while resetting the hydraulic enabled regulator circuit 110 to its initial position.

According to an example, the hydraulic enabled regulator circuit 110 may be constructed with a dual piston arrangement in which one piston is not mechanically biased and the other piston is mechanically biased in a given direction. On the first actuation, the two pistons move together to supply an initial, larger volume of fluid to move the actuator piston of the downhole device. For example, this initial, larger volume of fluid may be directed to a flow control valve actuator piston to provide an initial, incremental shift of the flow control valve from its fully closed position. In other words, this larger volume of fluid shifts the flow control valve from a closed position to a first or initial incremental position. The initial incremental movement may be a longer stroke of the actuator piston than subsequent incremental movements due to the larger volume of hydraulic actuation fluid initially directed to the actuator piston.

After actuation pressure is relieved, the mechanically biased piston, e.g. the smaller piston, resets back to its biased position. However, the other piston, e.g. the larger piston, remains in its secondary, shifted position. When actuation pressure is again applied, the mechanically biased piston moves while the other piston remains stationary thus supplying a smaller volume of fluid to index the downhole device, e.g. flow control valve, to the next incremental position.

After actuation pressure is again relieved, the mechanically biased piston similarly resets back to its biased position. The incremental actuations may be continued in this manner until there are no more positions with respect to shifting the downhole device. For example, the incremental actuations of a flow control valve may continue until the flow control valve is in its fully open position. The downhole device may be shifted in the opposite direction by applying hydraulic actuation fluid under pressure in the opposite control line to fully transition the downhole device in a single stroke. If the downhole device is a flow control valve, for example, hydraulic actuation fluid may be applied under pressure in the close hydraulic line to shift the flow control valve to a fully closed position in a single stroke. The single stroke also may be used to reset the hydraulic enabled regulator.

Although the operational example described above refers to flow control valves 48, the selective hydraulic circuit 56 may be used to control actuation of a variety of hydraulically actuated devices. Depending on the application, the components and component configurations of the well system 30 and selective hydraulic circuit 56 may vary. For example, the well system 30 also may comprise many types of well completions, flow control devices, or other types of hydraulically actuated devices disposed along a wellbore or other type of borehole.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for controlling flow in a well, the system comprising:

a well string having a plurality of flow control valves shiftable between an opened position and a closed position;

a common close hydraulic line connected to the plurality of flow control valves;

a plurality of open hydraulic lines, a corresponding open hydraulic line of the plurality of open hydraulic lines being coupled with a corresponding flow control valve of the plurality of flow control valves, wherein actuation of the corresponding open hydraulic line shifts the corresponding flow control valve to the opened position individually; and a plurality of selective close circuits, a corresponding selective close circuit being connected between the common close hydraulic line and the corresponding open hydraulic line of the corresponding flow control valve to enable closing of each of the plurality of flow control valves independently of each other.

2. The system as recited in claim 1, wherein the corresponding selective close circuit comprises an arrangement of valves configured to permit flow of actuating fluid from the common close hydraulic line to a flow control valve piston of the corresponding flow control valve to enable closing of the corresponding flow control valve upon application of a pressure increase followed by a pressure decrease in the corresponding open hydraulic line.

3. The system as recited in claim 2, wherein release of pressure in the common close hydraulic line and an increase of pressure in the corresponding open hydraulic line shifts the corresponding flow control valve to the opened position.

4. The system as recited in claim 2, wherein the arrangement of valves comprises a pilot to open valve positioned along the common close hydraulic line.

5. The system as recited in claim 4, wherein the arrangement of valves further comprises a pilot to close check valve and a check valve connected between the pilot to open valve and the corresponding open hydraulic line.

6. The system as recited in claim 2, wherein the arrangement of valves comprises a shuttle valve coupled between the common close hydraulic line and the corresponding open hydraulic line.

7. The system as recited in claim 6, wherein the arrangement of valves further comprises a pilot to close check valve in fluid communication with the shuttle valve.

8. The system as recited in claim 7, wherein the arrangement of valves further comprises a pilot to open check valve positioned along the common close hydraulic line and in fluid communication with the pilot to close check valve.

9. The system as recited in claim 8, wherein the arrangement of valves further comprises an additional check valve placed in fluid communication with the pilot to close check valve and the pilot to open check valve on one side of the additional check valve and with the corresponding open hydraulic line on the other side of the additional check valve.

10. The system of claim 1, wherein:

the corresponding flow control valve is configured to close by applying and holding pressure in the corresponding open hydraulic line of the corresponding flow control valve, applying pressure in the common close hydraulic line, and releasing pressure from the corresponding open hydraulic line of the corresponding flow control valve; and the corresponding flow control valve is configured to open by releasing pressure from the common close hydraulic line and applying pressure in the corresponding open hydraulic line of the corresponding flow control valve.

11. A method for selective actuation, the method comprising:

coupling a corresponding first hydraulic control line of a plurality of first hydraulic control lines to a corresponding control valve of a plurality of corresponding control valves positioned along a well string in a borehole, wherein the corresponding first hydraulic control line is configured to selectively actuate the corresponding control valve coupled to the first hydraulic control line to a first position individually by pressure applied in the corresponding first hydraulic control line coupled to the corresponding control valve;

connecting the plurality of corresponding control valves to a common second hydraulic control line; and using a selective close circuit, coupled between the corresponding first hydraulic control line and the common second hydraulic control line, to control actuation of individual corresponding control valves to a second position via an application of pressure in the common second hydraulic control line without transitioning other control valves to the second position.

12. The method as recited in claim 11, wherein the plurality of corresponding control valves comprises a plurality of flow control valves, the plurality of first hydraulic control lines comprises open hydraulic lines, and the common second hydraulic line comprises a common close hydraulic line.

13. The method as recited in claim 12, wherein using the selective circuit comprises pressuring up a corresponding open hydraulic line coupled with a specific, selected flow control valve to transition the selective circuit to a position placing the common close hydraulic line in communication with the specific, selected flow control valve.

14. The method as recited in claim 13, further comprising:

releasing pressure in the corresponding open hydraulic line; and pressuring up the common close hydraulic line to transition the specific, selected flow control valve to a closed position without transitioning other flow control valves of the plurality of flow control valves.

15. The method as recited in claim 14, wherein using the selective circuit comprises actuating a pilot to open valve positioned along the common close hydraulic line, the pilot to open valve being actuated via increasing pressure in the corresponding open hydraulic line.

16. The method as recited in claim 15, wherein using the selective circuit further comprises using a pilot to close check valve and a parallel check valve coupled between the pilot to open valve and the corresponding open hydraulic line.

17. The method as recited in claim 14, wherein using the selective circuit comprises actuating a shuttle valve coupled between the common close hydraulic line and the corresponding open hydraulic line.

18. The method as recited in claim 17, wherein using the selective circuit comprises employing a pilot to close check valve in fluid communication with the shuttle valve and a pilot to open check valve positioned along the common close hydraulic line and in fluid communication with the pilot to close check valve.

19. The method of claim 11, wherein:

each of the corresponding control valves is configured to actuate to the second position by applying and holding pressure in the corresponding first hydraulic control line, applying pressure in the common second hydraulic control line, and releasing pressure from the corresponding first hydraulic control line; and each of the corresponding control valves is configured to actuate to the first position by releasing pressure from the common second hydraulic control line and applying pressure in the corresponding first hydraulic control line.

20. A system for selective actuation of a plurality of control valves, the system comprising:

the plurality of control valves positioned along a well string in a borehole, the control valves being individually shiftable between a first position and a second position, wherein each control valve of the plurality of devices control valves is configured to individually shift to the first position by pressure applied in a dedicated first hydraulic control line coupled to the control valve;

a common second hydraulic control line coupled to the plurality of control valves; and a selective close circuit connected to each dedicated first hydraulic control line and to the common second hydraulic control line, the selective circuit being actuatable via an application of pressure applied to the dedicated first hydraulic line to shift the control valve coupled to the dedicated first hydraulic line to the second position via an application of pressure in the common second hydraulic control line without transitioning other control valves to the second position.

21. The system as recited in claim 20, wherein the plurality of control valves comprises flow control valves.

22. The system as recited in claim 21, wherein the dedicated first hydraulic control lines are open hydraulic control lines for shifting the flow control valves to opened positions, and the common second hydraulic control line is a close hydraulic control line.

23. The system of claim 20, wherein:

each control valve is configured to transition to the second position by applying and holding pressure in the dedicated first hydraulic control line, applying pressure in the common second hydraulic control line, and releasing pressure from the dedicated first hydraulic control line; and each control valve is configured to transition to the first position by releasing pressure from the common second hydraulic control line and applying pressure in the dedicated first hydraulic control line.

* * * * *